US005626321A

United States Patent [19]

Ulshafer, Jr.

[11] Patent Number: 5,626,321

[45] Date of Patent: May 6, 1997

[54] WOODWORKING PORTABLE TOOL MOUNTING ASSEMBLY FOR SAWHORSE

[76] Inventor: Carl Ulshafer, Jr., 501A W. 7th St., Ida Grove, Iowa 51445

[21] Appl. No.: 394,770

[22] Filed: Feb. 27, 1995

[51] Int. Cl.[6] ..... E04G 1/00

[52] U.S. Cl. ..... 248/231.41; 182/181; 248/316.8; 248/675

[58] Field of Search ..... 182/181, 129, 182/149, 153; 248/316.8, 229.12, 680, 675, 231.41, 228.3, 298; 269/303, 97, 153, 87.1

[56] References Cited

U.S. PATENT DOCUMENTS

| | | | |
|---|---|---|---|
| 143,734 | 10/1873 | Utter | 269/97 X |
| 1,914,291 | 6/1933 | Reid | 182/186 X |
| 2,967,585 | 1/1961 | Bybee et al. | 182/184 |
| 4,062,423 | 12/1977 | Armbruster | 182/129 |
| 4,101,061 | 7/1978 | Sage et al. | 248/231.41 X |
| 4,330,113 | 5/1982 | Ferdinand et al. | 269/97 X |
| 4,381,103 | 4/1983 | Ferdinand et al. | 269/97 X |
| 4,386,767 | 6/1983 | Dyckes et al. | 182/129 X |
| 4,645,162 | 2/1987 | Roy et al. . | |
| 4,913,425 | 4/1990 | Anderson | 269/97 |
| 5,090,283 | 2/1992 | Noble | 269/303 X |
| 5,119,903 | 6/1992 | Ulshafer, Jr. . | |
| 5,490,665 | 2/1996 | Thiele et al. | 269/303 |

FOREIGN PATENT DOCUMENTS

| | | | |
|---|---|---|---|
| 7604878 | 11/1977 | Netherlands | 248/231.41 |

OTHER PUBLICATIONS

Copy – pp. 4, 5, 10, 11, 14 & 15 from Woodsmithshop Catalog – Holiday 1994 brochure showing different table saws.

*Primary Examiner*—Derek J. Berger
*Attorney, Agent, or Firm*—Henderson & Sturm

[57] ABSTRACT

An assembly for removably mounting a portable power tool onto the top board or plank of a sawhorse, one or more assemblies used for the purpose, which assembly has an elongated track unit securable to the power tool and to the board such that opposed ends of the track unit extend outwardly beyond the sides of the board; a pair of clamps slidably mounted on the track unit, each clamp on an extended track unit end and slidably engageable with the board, and a jack handle having a rod inserted through the clamps and operable therewith to move the clamps into and out of engagement with the board, whereby to hold the power tool in a securely mounted position for use of the power tool.

11 Claims, 2 Drawing Sheets

WOODWORKING PORTABLE TOOL MOUNTING ASSEMBLY FOR SAWHORSE

TECHNICAL FIELD

This invention relates generally to workbenches in connection with the use of portable woodworking power tools, and more particularly to a universal mounting assembly for attaching a portable power tool to a conventional sawhorse.

BACKGROUND ART

The growth in the development of portable power tools for primarily woodworking purposes has encouraged manufacturers to increase their versatility by designing workbenches to accommodate the various types of power tools and convert them into table tools.

In response, the manufacturers of workbenches are designing more varied types of bench tops to receive the portable power tools. It is not unusual for a single bench top, for example, to have a complement of inverted T-slots formed therein, other recessed slots of various shapes, tracks built therein and vices and clamps, whether bar, pistol or pipe secured thereto in various arrangements.

Regardless, the contemporary workbenches still rely primarily on permanently attaching the power tool to the workbench, such that an individual workbench is necessary, in many instances, for each different type of power tool. To a solution of that problem this invention is directed.

DISCLOSURE OF THE INVENTION

The present invention is an assembly for removably mounting a portable power tool used primarily for woodworking onto a board, such as a 2"×4" or 2"×6" mounted in turn on a sawhorse. The assembly comprises generally: an elongated track unit having a length more than the width of the board such that when placed across the board at right angles, opposed end portions of the track unit extend beyond the sides of the board, an inverted T-slot formed in the track unit; a pair of identical clamps slidably mounted on the track unit for relative movement longitudinally of the unit, at least one clamp movable toward and away from the other, and with the board disposed between the clamps; and a motion transmitting unit including an externally threaded jack handle inserted through the clamps, rotation of which provides for engaging the board at opposite sides by the clamps for securing the track unit to the board.

By using a pair of such assemblies, for example, and by mounting them on the board of a sawhorse in an adjustable relation longitudinally of the sawhorse, a plurality of varied portable power tools can be removably attached to the track units, the assembly providing a universal mounting alternative for the consumer. He can thus store his woodworking power tools on a shelf, and when needed simply attach the one desired to a sawhorse via the assembly, thus obviating the need for one or more special workbenches.

It is an object of this invention to provide a new and novel assembly for mounting a portable power tool in a stationary manner on a sawhorse or like support.

Still another object of this invention is to provide a portable power tool mounting assembly which does not require a standard workbench.

Yet another object of this invention is the provision of an assembly enabling removably mounting a portable woodworking power tool on a sawhorse.

Another object of this invention is the provision of an assembly attachable to a sawhorse for independently mounting a variety of portable power tools on the sawhorse.

Still another object of this invention is the provision of an assembly for achieving the aforementioned objectives which is economical of manufacture, and simple of construction and use.

BRIEF DESCRIPTION OF THE DRAWINGS

These and other attributes of the invention will become more clear upon making a thorough review and study of the following description of a preferred embodiment, particularly when reviewed in conjunction with the drawings, wherein.

DESCRIPTION OF THE PREFERRED EMBODIMENT

Figure 1:
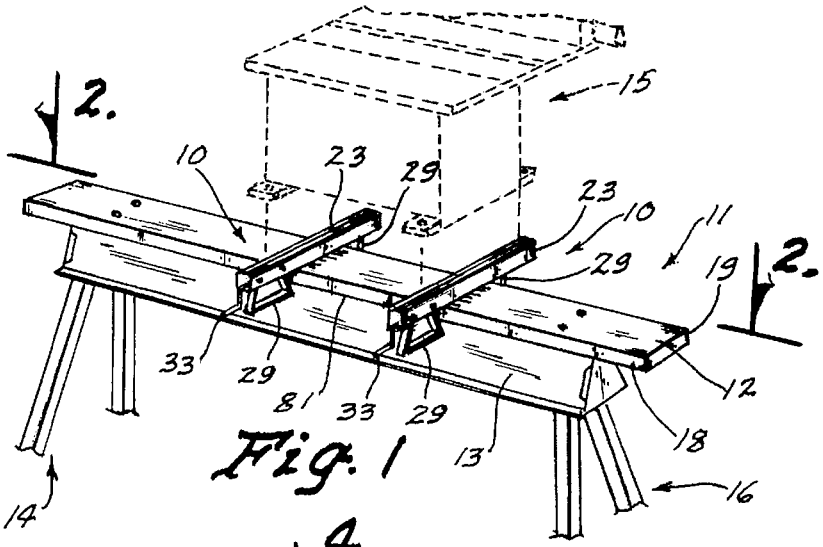
FIG. 1 is a perspective view of a pair of assemblies of this invention shown attached to a sawhorse, and showing in dashed lines a portable miter saw attachable to the spaced assemblies.
Figure 2:
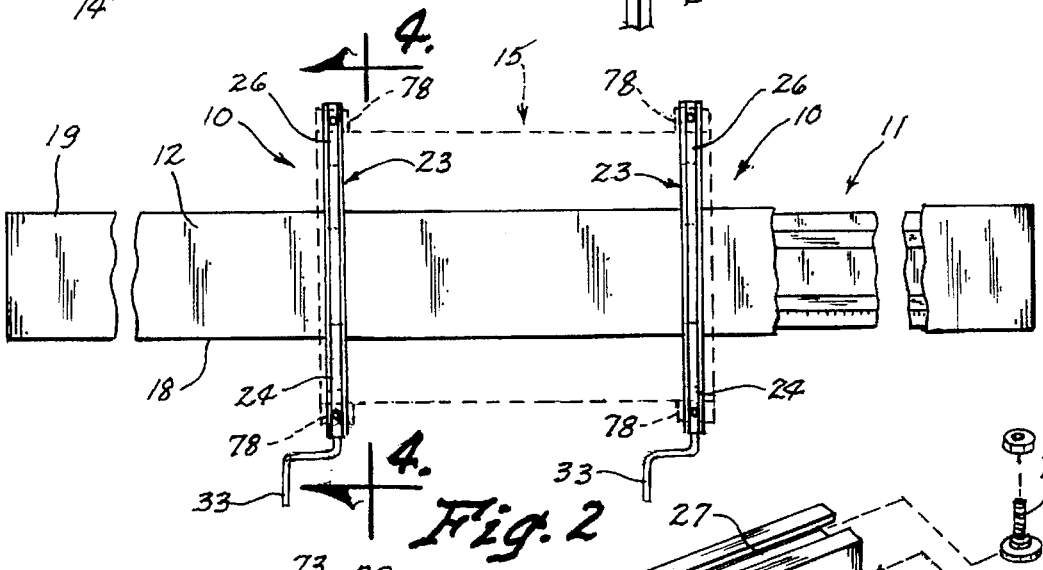
FIG. 2 is an enlarged plan view taken along the line 2—2 in FIG. 1, with the miter saw again shown by dashed lines.
Figure 3:
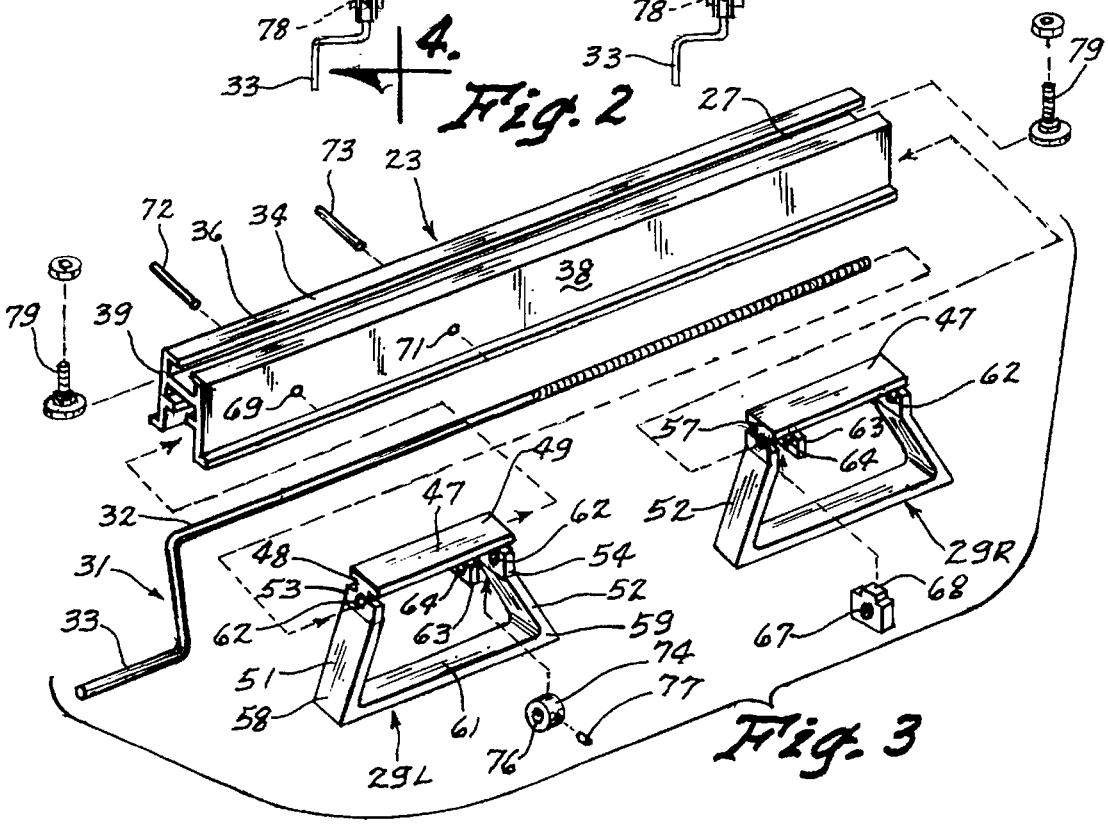
FIG. 3 is a further enlarged, exploded perspective view of the components of a single mounting assembly.

Referring particularly to FIGS. 1–3, the portable power tool mounting assembly of this invention is indicated at (10), and it will be noted that a pair of assemblies (10) are shown mounted on a sawhorse (11) (FIG. 1), the longitudinal spacing of the assemblies (10) set for mounting a conventional miter saw (15) on the sawhorse (11).

Figure 4:
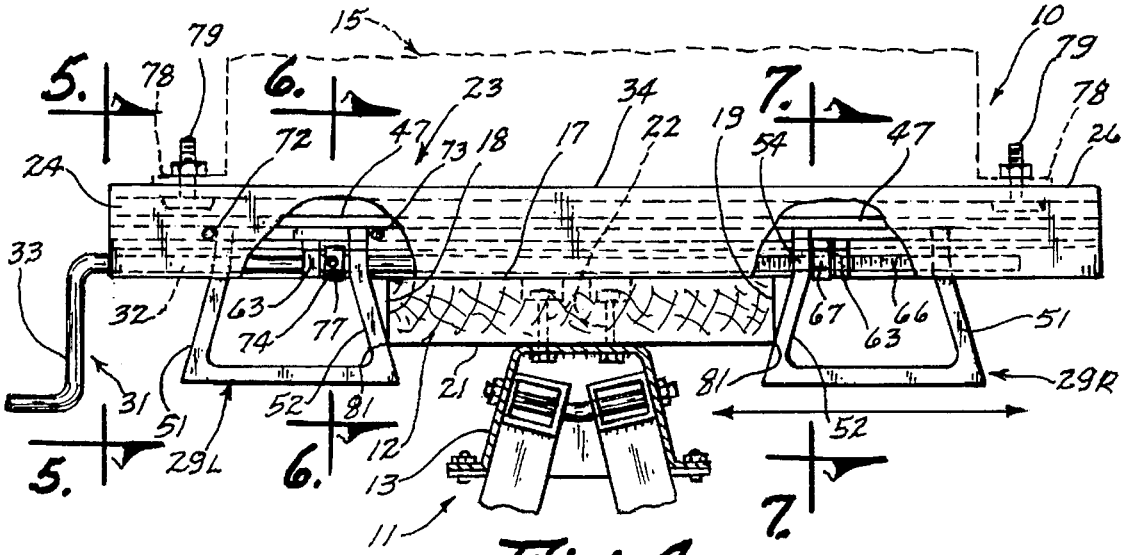
FIG. 4 is a side elevational view of an assembly as taken along the line 4—4 in FIG. 2, with certain parts broken away for purposes of clarity.

The sawhorse (11) may be of a general type shown in U.S. Pat. Nos. 4,645,162 or 5,119,903 and comprises at least an elongated—usually wooden board (12), either a 2"×4" or 2"×6" in cross-section, mounted on a pair of brackets or an elongated cross member (13), and with a pair of legs (14), (16) at each end of the cross member (13) for support. In many instances of use, a pair of sawhorses (11) are used, but only one is needed for the present invention as will be more readily apparent. The board (12) has a substantially flat top surface (17) (FIG. 4) with laterally spaced side edges (18), (19) and a bottom surface (21). A pair of bolt fasteners (22) may be used for securing the board (12) to the top of the cross member (13) as best shown in FIG. 4.

Figure 5:
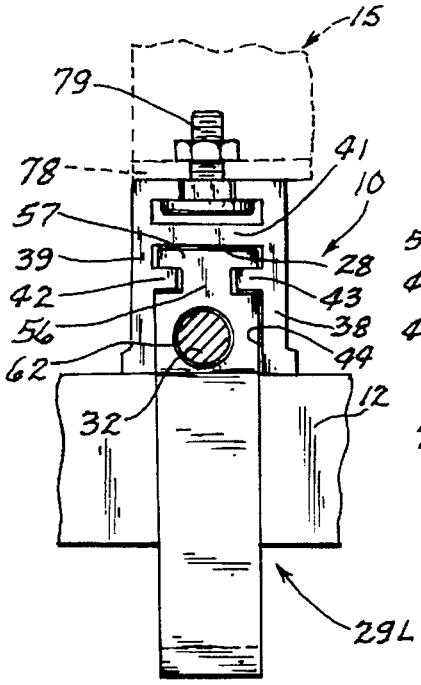
FIG. 5 is a further enlarged end elevational view as taken along the line 5—5 in FIG. 4.
Figure 6:
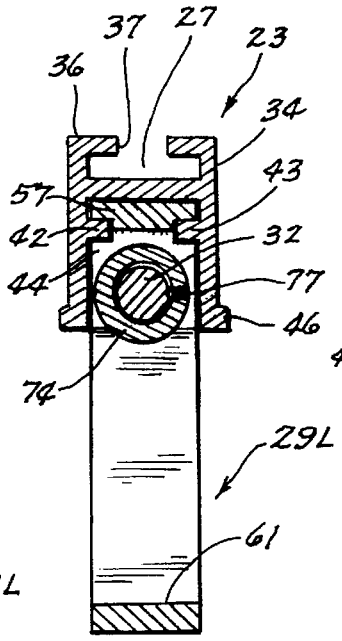
FIG. 6 and 7 are sectional views taken, respectively, along the lines 6—6 and 7—7 in FIG. 4.
Figure 7:
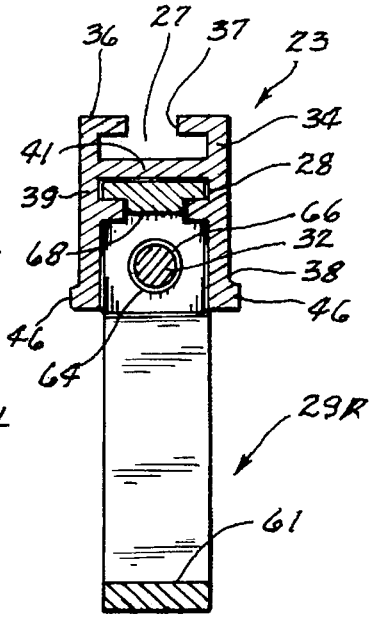

As each assembly (10) is identical only one will be described. The assembly (10) comprises generally an elongated track unit (23) (FIG. 3) having a length such that upon placing the track unit (23) upon the board (12) (FIGS. 1 and 2) wherein the length of the track unit (23) is normal to the length of the board (12), the track unit (23) has outer opposed end portions (24), (26) (FIG. 4) extended beyond the board side edges (18), (19), the track unit (23) having further an upper track slot (27) (FIGS. 6 and 7) for use in attachment to a portable tool, in this instance the miter saw (15) (FIG. 5), the track unit (23) having still further a lower track slot (28) (FIGS. 6 and 7) disposed below the upper slot (27).

The assembly (10) comprises further a pair of identical clamps (29) (FIG. 3) each slidably movable within the lower slot (28) (FIGS. 4 and 5), the pair of clamps (29L—left and 29R—right, for example) slidably movable relative to each other respectively on the outer track unit end portions (24), (26) and relative to the side edges (18), (19) of the board (12) whereby to engage the side edges (18), (19).

To move the clamps (29L), (29R), a motion transmitting device (31) (FIG. 3) is provided, which device (31) includes an elongated rod (32) with a jack handle (33) at one end, the rod inserted through the clamps (29L), (29R) (FIG. 4) and operably engaged therewith whereby to move the clamps (29L), (29R) into and out of engagement with the board side edges (18), (19) to releasably fasten the track unit (23) to the board (12).

More particularly, the track unit (23) comprises a track member (34) having generally an H-shape in cross section (FIGS. 5–7) with a top element (36) having an elongated cut-out portion (37) formed along the longitudinal centerline of the top element (36); a pair of sides (38), (39) depending in laterally spaced relation from the top element (36); a connector (41) extended internally between and connecting the sides (38), (39) and separating thereby the upper slot (27) from the lower slot (28). By the provision of a pair of flanges (42), (43) integral with the sides (38), (39) and extended toward each other but not connected, the lower slot (28) has a T-shape, similar to the inverted T-shape of the upper slot (27). An elongated passage (44) is formed between the sides (38), (39) and below the flanges (42), (43), the passage (44) extended longitudinally the length of the track member (34). Feet (46) are formed at the bases of the sides (38), (39). Both the upper and lower slots (27), (28) extend longitudinally the track member (34), and parallel each other.

Each clamp (29) has a trapezoidal shape in side elevation (FIG. 4) with a top element (47) with opposed outer ends (48), (49), a pair of legs (51), (52) each integral at an upper end (53), (54), respectively, with an outer end (48), (49), respectively, and with each upper end (53), (54) having a neck portion (56) (FIG. 5) formed therein, forming thereby a T-shaped head portion (57) with the top element (47), the head portion (57) slidably movable within the upper track slot (27), (FIG. 5) the width of the clamp (29) such as to slidably fit between the track member sides (38), (39), and with the legs (51), (52) having lower ends (58), (59) (FIG. 3) joined by a base (61).

Formed within each clamp top element (47) below the neck portion (56) is a passage or opening (62), the openings (62) being longitudinally aligned; and a spacer (63) having a width the same as a clamp leg (51), (52) is secured to the underside of the top element (47), depended below and is spaced closely adjacent one leg (52), for example, (FIG. 4). The spacer (63) has a passage or opening (64) formed therein aligned with the clamp openings (62).

The motion transmitting rod (32) is externally threaded for example, at an outer end (66), and upon being inserted through the clamp openings (62) and the spacer openings (64), is adapted to be threadably inserted through an internally threaded nut (67) (FIG. 3), which nut (67) is inserted between the spacer (63) and adjacent leg (52) of one clamp (29R) for example, (FIG. 4). It may readily be appreciated that rotation of the jack handle (33) will move the clamp (29R) toward or away, depending on the direction of rotation, the other clamp (29L) and toward or away from the board (12). The nut (67) has a shape in side elevation which fits into the space (60), with a reduced upper portion (68) which fits into the T-shaped lower slot (28), thereby preventing the nut (67) from rotating in place in response to rotation of the rod (32).

To secure the other clamp (29L), for example, to the track member (34), a pair of holes (69), (71) (FIG. 3) are formed through the track member sides (38), (39) in transverse alignment, the holes (69), (71) being longitudinally spaced of a distance slightly greater than the length of a clamp (29), such that the clamp (29L) may be bracketed by a pair of pins (72), (73) inserted through the holes (69), (71) (FIG. 4); the clamp (29L) thereby being prevented from movement.

To further lock the jack handle rod (32) against movement longitudinally of the track member (34), a second nut (74) is inserted between the spacer (63) and adjacent leg (52) of the non-moving clamp (29L) (FIGS. 3 and 4). This nut (74), however, is circular with a bore (76) formed therein for receiving the rod (32), and with an Allen screw (77), for example, inserted through the nut (74) for securement to the rod (32). With the nut (74) bracketed against longitudinal movement relative to the track member (34), the rod (32) thus is also not movable longitudinally of the track member (34), but of course is free to rotate in place within the openings (62) and (64).

Thus, by placing a pair of assemblies (10) in a predetermined spaced relation on the sawhorse (11), such that for example, the feet (78) of the miter saw (15) are placed directly over the track members (32), fasteners (79) (FIG. 5) may be inserted into the upper slots (27) for fastening down the feet (78) of the saw (15) to the track member top element (36). Further, as the respective clamps (29L) and (29R) of each assembly (10) are moved into clamping engagement with each board (12), as the clamping engagement tightens, it tends to pull each track member (32) down onto the board (12) due to the slant of each engaging clamp leg (52) causing the legs (52) to engage the lower corners (81) (FIG. 4) of the board (12), the legs (52) extended slightly upwardly and away from their engagement with the board side edge (18), (19) at an acute angle.

As another example of the operable relationship between the rod (32) and the clamps (29L), (29R), the inner end of the rod (32) could be externally threaded at the end opposite the outer end (66) with the opposite threads being oppositely or reversely threaded, such that by replacing the non-threaded nut (74) with a nut identical to nut (67), and by removing the pins (72), (73), rotation of the rod (32) in one direction could cause movement of the clamps (29L), (29R) toward each other, and rotation of the rod (32) in the opposite direction would then result in the clamps (29L), (29R) moving away from each other.

Thus is can be seen that at least all of the stated objectives have been achieved.

Obviously many modifications and variations of the present invention are possible in light of the above teachings. It is therefore to be understood that, within the scope of the appended claims, the invention may be practiced otherwise than as specifically described.

I claim:

1. For use with a stationary, elongated board having a substantially flat top surface and laterally spaced side edges, an assembly for removably mounting a woodworking portable tool onto the board, comprising:

an elongated track unit having a length such that upon placing said track unit upon the board wherein the length of said track unit is normal to the length of the board, said track unit has outer opposed end portions extended beyond the board side edges, said track unit having further an upper track slot for use in attachment to a portable tool, said track unit having still further a lower track slot;

means including a pair of clamps slidably mounted within said lower track slot, said clamps slidably movable relative to each other respectively on said outer end portions and relative to said board side edges whereby to engage said board; and motion transmitting means inserted through and operably engaged with said clamps to slidably move said clamps into and out of engagement with said board side edges whereby to releasably fasten said track unit to the board.

2. The assembly of claim 1, and with said track unit upper track including a track member with said upper slot extended longitudinally of said member.

3. The assembly of claim 2, and with said track member lower slot extended longitudinally of said member and disposed parallel to said upper slot.

4. The assembly of claim 3, and with said track member having a passage disposed below said lower slot, said passage extended longitudinally of said member and parallel said lower slot.

5. The assembly of claim 4, and with each said clamp having a top element with opposed outer ends, a pair of legs each integral at an upper end with a said outer end, each said upper end having a neck portion formed therein forming thereby a T-shaped portion with said top element, said T-shaped portion slidably movable within said lower track slot.

6. The assembly of claim 5, and with each clamp having a passage formed in each said leg below said neck portion, said passages longitudinally aligned for receiving said motion transmitting means therethrough.

7. The assembly of claim 6, and with at least one clamp having a spacer extended below said top element and spaced longitudinally from an adjacent one of said legs, each spacer having a passage formed therein longitudinally aligned with said clamp passages.

8. The assembly of claim 7 and with said motion transmitting means comprising an elongated rod with a jack handle at one end thereof, said rod having external threads formed thereon.

9. The assembly of claim 8, and with internally threaded means inserted adjacent said spacer of one clamp for receiving said rod, said rod inserted through said leg passages and spacer passages of both said clamps, said threaded means operable upon rotation of said jack handle to move said one clamp toward or away from the other said clamp and the board therebetween.

10. The assembly of claim 9 and with means securing said other clamp to said track unit whereby rotation of said jack handle results in non-movement of said other clamp.

11. The assembly of claim 10 and with means inserted between said spacer and an adjacent leg of said other clamp whereby to secure said rod against longitudinal movement within said passages.

* * * * *